US005125977A

United States Patent [19]

Grohmann et al.

[11] Patent Number: 5,125,977

[45] Date of Patent: Jun. 30, 1992

[54] TWO-STAGE DILUTE ACID PREHYDROLYSIS OF BIOMASS

[75] Inventors: Karel Grohmann, Winter Haven, Fla.; Robert W. Torget, Littleton, Colo.

[73] Assignee: The United States of America as represented by the United States Department of Energy, Washington, D.C.

[21] Appl. No.: 681,299

[22] Filed: Apr. 8, 1991

[51] Int. Cl.[5] ..... C13D 1/14; C13K 13/00

[52] U.S. Cl. ..... 127/36; 127/37; 127/38; 127/44

[58] Field of Search ..... 127/36, 37, 38, 44

[56] References Cited

U.S. PATENT DOCUMENTS

| | | | |
|---|---|---|---|
| 1,190,953 | 7/1916 | Renshaw | 127/36 |
| 3,132,051 | 5/1964 | Nobile et al. | 127/38 |
| 3,954,497 | 5/1976 | Friese | 127/37 |
| 3,990,904 | 11/1976 | Friese et al. | 127/37 |
| 4,029,515 | 6/1977 | Kiminki et al. | 127/37 |
| 4,072,538 | 2/1978 | Fahn et al. | 127/37 |
| 4,105,647 | 8/1978 | O'Farell et al. | 526/33 |
| 4,168,988 | 9/1979 | Riehm et al. | 127/37 |
| 4,556,430 | 12/1985 | Converse et al. | 127/36 |
| 4,908,067 | 5/1990 | Just | 127/44 |

*Primary Examiner*—Theodore Morris
*Assistant Examiner*—P. L. Hailey
*Attorney, Agent, or Firm*—Kenneth Richardson; James W. Weinberger; William R. Moser

[57] ABSTRACT

A two-stage dilute acid prehydrolysis process on xylan containing hemicellulose in biomass is effected by: treating feedstock of hemicellulosic material comprising xylan that is slow hydrolyzable and xylan that is fast hydrolyzable under predetermined low temperature conditions with a dilute acid for a residence time sufficient to hydrolyze the fast hydrolyzable xylan to xylose; removing said xylose from said fast hydrolyzable xylan and leaving a residue; and treating said residue having a slow hydrolyzable xylan with a dilute acid under predetermined high temperature conditions for a residence time required to hydrolyze said slow hydrolyzable xylan to xylose.

8 Claims, 1 Drawing Sheet

TWO-STAGE DILUTE ACID PREHYDROLYSIS OF BIOMASS

CONTRACTUAL ORIGIN OF THE INVENTION

The United States Government has rights in this invention under Contract No. DE-AC02-83CH10093 between the U.S. Department of Energy and the Solar Energy Research Institute, a Division of Midwest Research Institute.

BACKGROUND OF THE INVENTION

1. FIELD OF THE INVENTION

The invention relates to a two stage dilute acid prehydrolysis of biomass for solubilization of hemicellulosic sugars and a pretreatment for enzymatic hydrolysis of cellulose. In particular, the invention pertains to a two-stage dilute acid prehydrolysis treatment of a feedstock of hemicellulosic material comprising xylan that is slow hydrolyzable and xylan that is fast hydrolyzable under low temperature conditions to hydrolyze said fast hydrolyzable xylan to xylose; removing said xylose and leaving a feedstock residue containing said slow hydrolyzable xylan; treating said residue containing said slow hydrolyzable xylan with a dilute organic or inorganic acid under temperature conditions higher than said low temperature conditions to hydrolyze said slow hydrolyzable xylan to xylose, and removing said xylose.

2. DESCRIPTION OF THE PRIOR ART

U.S. Pat. No. 4,072,538 to Fahn et al. is directed to a process for the two-stage decomposition of hemicellulose to xylan containing natural products for the purpose of obtaining xylose, wherein the starting material is a basic medium and the residue is treated with an acid treatment, and the two stages are carried in the same reaction vessel.

U.S Pat. No. 4,105,647 to Buckl et al. employs a method for the two-stage digestion of natural products containing xylan in order to obtain xylose, wherein a vegetable material is treated with a basic substance and the residue is treated with an acid. The process uses two stages and is done at temperatures of from 50 to about 60 degrees celsius.

In U.S. Pat. No. 3,990,904 to Friese et al., xylose is prepared from oat husks by hydrolyzing oat husks with solutions of alkali metal hydroxide to remove acetic acid and then hydrolyzing the oat husks with a mineral acid to provide a solid residue containing lignin and xylose.

U.S. Pat. No. 3,954,497 to Friese is directed to a process for the hydrolysis of deciduous wood, wherein the hydrolysis is carried out in a first stage with an alkali metal hydroxide solution and in a second stage with a mineral acid. The resulting product is D-xylose.

The factor in common in all four of the foregoing patents is the use of two-stage treatments of biomass for the production of xylose; however, the first treatment is with an alkaline solution and the second treatment step is an acid hydrolysis step.

U.S. Pat. No. 4,168,988 to Riehm et al. pertains to a process for the winning of xylose, by hydrolysis of residues of the annuals. Xylose is produced from annuals by extracting substances from the annuals with an acid solution, then pressing, moistening with an acid solution, hydrolyzing by increasing the temperature, terminating the hydrolysis by dropping the temperature, extracting with water and purifying. However, while this is a two-stage process in which biomass is first washed with dilute acid and then hydrolyzed with dilute acid, the washing step is for purposes of removing cations, water soluble sugars and other extractives, and hydrolyzes only arabinose and other easy to hydrolyze linkages. The xylan bonds are not hydrolyzed during the first step, because this step is for the purpose of removing impurities from the xylose solution produced during the second, single-stage step.

U.S. Pat. No. 4,029,515 to Kiminki et al. is directed to a two-stage acid hydrolysis process, wherein xylose produced in the first stage is simultaneously converted to furfural.

In biomass materials, cellulose and hemicellulose are the two most abundant and renewable raw organic compounds, and together they compose about 70 percent of the entire world's plant biomass on a dry weight basis. These raw materials are widely available in waste from agricultural, forest, vegetable, and food process sources and the efficient recycling of these wastes to useful products, such as ethanol, would help reduce disposal problems as well as provide an abundant and cheap source of fuel.

Unlike cellulose, hemicellulose is readily and easily converted to its various hydrolysate by-products by mild acid hydrolysis or enzymatic hydrolysis treatment and the resultant byproducts include various pentoses (xylose and arabinose being the main derivatives), hexoses (mannose and galactose), and sugar acids. By far, D-xylose is the major hemicellulose hydrolysate and constitutes approximately 60 percent of the total hydrolysates produced therefrom.

However, under conventional processes, the xylose being formed by hydrolysis of xylan is also being continuously converted to furfural and other undesirable by-products of sugar decomposition, which are toxic to yeast and not convertible to ethanol. Thus, the yield of xylose achievable is limited, which in turn would decrease the ethanol yield upon fermentation.

SUMMARY OF THE INVENTION

It is an object of the invention to surmount the limiting mechanisms of conventional processes of producing xylose and provide a high degree of hydrolysis of xylan, to over 90%.

A further object of the invention is to provide a two-stage dilute acid prehydrolysis of biomass for solubilization of hemicellulosic sugars and a pretreatment for enzymatic hydrolysis of cellulose.

A yet further object of the invention is to provide a two-stage dilute acid prehydrolysis of a feedstock of hemicellulosic material comprising xylan that is slow hydrolyzable and xylan that is fast hydrolyzable under low temperature conditions to hydrolyze said fast hydrolyzable xylan to xylose; remove said xylose and leave a feedstock residue containing said slow hydrolyzable xylan; treat said residue containing said slow hydrolyzable xylan with a dilute inorganic or organic acid or mixture thereof under temperature conditions higher than said low temperature conditions to hydrolyze said slow hydrolyzable xylan to xylose; and remove said xylose.

The two-stage dilute acid prehydrolysis process may be a parallel process where the substrate is contacted with fresh acid in both stages or a quasi counter current process where only the second stage substrate is contacted with a fresh acid and the first stage substrate is hydrolyzed by an acid and sugar stream from the second stage.

DETAILED DESCRIPTION OF THE INVENTION

Figure 1:
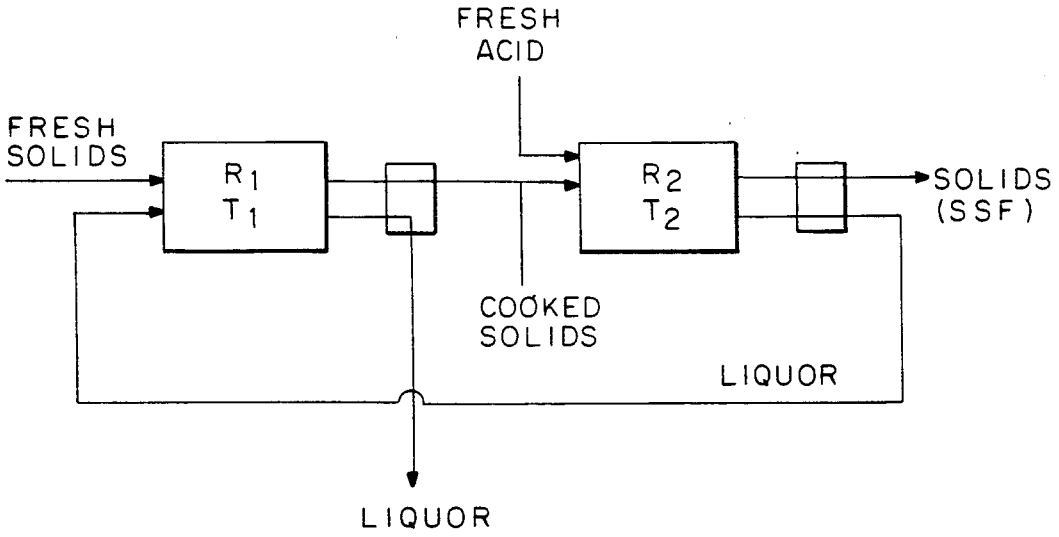
FIG. 1 is a flow diagram depicting the process of introducing xylan containing biomass into a two-stage dilute acid prehydrolysis reactor system of the invention.

It is a discovery of the invention that the hydrolysis of hemicellulose in cellulosic materials such as hard woods, straw, and other plant material is biphasic, i.e., that in the case of hardwoods, about 70% of the hemicellulose can be hydrolyzed much faster (fast hydrolyzable xylan) than the remaining 30% (slow hydrolyzable xylan).

In general, this is accomplished by taking biomass material such as aspen wood meal comprising xylan, adding water thereto and subjecting the material to a temperature between the ranges of about 90° C. to about 180° C., adding a dilute mineral or organic acid or mixtures of these acids, separating the contents into liquid and solid fractions, and analyzing the combined filtrate for xylose.

The pretreated solid is then added to a second reactor along with water and subjected to a temperature range of between about 160° to about 220° C., and a dilute mineral or organic acid is added or mixed with water previously used. The pretreated solid is kept in the second reactor for a period of about one-half of the time (4 minutes) that the wood meal is kept in the first reactor, and the solid and liquor are separated by filtration, and the combined liquor and the solid are analyzed for free xylose and xylan contents.

The invention can best be understood by referring to the flow diagram of FIG. 1 together with the example.

In the flow diagram, T represents the temperature and $T_1 < T_2$. R represents the residence time and $R_1 \geqq R_2$.

EXAMPLE 25.0 grams of aspen wood meal (ground to pass through a 2 mm screen) were added to a liter Parr stirred impeller type reactor made of acid-resistant stainless steel. 203.8 ml of water containing 0.6989 g of free xylose (or 0.644 g equivalent xylan corrected for hydration) was then added. The calculated free xylose was obtained from optimization studies using computer modeling of the reactor flow diagram. The reactor was then sealed and heated by stirring at 80 rpm to 145° C. by resistance heating. Once the reactor reached 145° C., 11.25 ml of 9.0% sulfuric acid (v/v) were added to the reactor under nitrogen pressure followed by a 10.0 ml water wash. The reaction proceeded 8.0 minutes and was quenched by submerging the reactor in an ice bath. The contents were then separated into liquid and solid fractions by filtration. The solid was washed extensively with water to a pH of 4.5. The combined filtrate was analyzed for xylose.

57.70 g of the pretreated solid (which was 23.0% solids and 77.0% water) was then added to the Parr reactor along with 123.0 ml water. The reactor was then sealed and heated to 180° C. with constant stirring (80 rpm). Once the reactor reached 180°, 9.34 ml of 9% sulfuric acid (v/v) were added by nitrogen over pressure followed by 10.0 ml wash water. After the reaction proceeded for 4.0 minutes the reaction was quenched by submerging it in an ice bath. The solid and liquor was once again washed repeatedly with water to a pH of 4.5. The combined liquor and the solid were analyzed for free xylose and xylan content.

The chemical analysis for xylose and xylan content for the 145° C. pretreatment was as follows: The solid contained 20.6% of the starting xylan content of the aspen meal. All but 3.6% of the hydrolyzed xylose from the aspen meal was recovered in the liquor.

The chemical analysis for xylose and xylan content for the 180° C. pretreatment was as follows: The solid contained 3.9% of the original xylan content of aspen meal. After taking into account the free xylose measured in the liquor and the xylan content of the pretreated solid, all but 8.6% of the available xylose was recovered.

Therefore, by using this two-stage hydrolysis scheme for xylan removal from aspen wood meal, the liquor from reactor 1 contains 90.75% of the available xylose; the solid residue from reactor 2 contains 3.9% of the original xylan; and 5.35% of the xylan is lost to degradation reactions. The xylose remaining in solid residue can be recovered by enzymatic hydrolysis of both xylan and cellulose.

It is apparent from the example that the two stage hydrolysis of hemicellulose from biomass takes advantage of the acid catalyzed release of at least two classes of hemicellulosic sugars. The two reactors can be optimized for release of hemicellulosic sugars as to the acid concentration, temperature and feed chemical composition, and the reactors can be run either quasi counter current or in parallel.

A variety of well known yeasts can be used to ferment the xylose obtained in the process of the invention to ethanol; or, the invention process can be used in tandem with a simultaneous saccharification fermentation (SSF) system, as is shown in FIG. 1.

The dilute acid catalyzed hydrolysis of hemicellulosic sugars from various forms of biomass can be modeled kinetically using the following model:

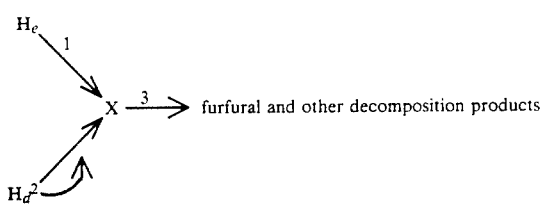

where $H_e$ and $H_d$ are the "fast" and "slow" removable fractions of hemicellulosic sugars and X is monomeric and soluble polymeric hemicellulosic sugars. The variation of individual components based upon the above model can be described by the following set of differential equations:

$$\frac{dH_e}{dt} = -k_1 H_e \quad (1)$$

$$\frac{dH_d}{dt} = -k_2 H_d \quad (2)$$

$$\frac{dX}{dt} = k_1 H_e + k_2 H_d - k_3 X \quad (3)$$

where $k_1 = k_d(A)^{N_i} \exp(-E_1/RT)$ once $k_1$, $k_2$ and $k_3$ have been experimentally determined for a particular feedstock along with the respective energies of activation ($E_i$), pre-exponential ($k_d$), and acid concentration exponents ($N_i$), the three differential equations can be solved simultaneously to yield the following results.

a) In the countercurrent reactor scheme, iterative calculations will optimize acid concentration, temperature, and feed concentration of free hemicellulosic sugars from the upstream reactor and will yield a "low temperature" isothermal reactor producing a substrate nearly completely void of the "fast" xylan fraction. The resulting substrate will be treated in the "high temperature" isothermal reactor using the predetermined acid concentration from the low temperature reactor to yield a substrate containing a very small amount of xylan which would not interfere with xylan or cellulose saccharification by cellulase enzyme systems. The acid solution from the high temperature reactor will be used to treat wood substrate in the low temperature reactor; and b) In a parallel reactor configuration, two reactors will be run independently from one another with a separation step in between reactors washing out free hemicellulosic sugars. The first "low temperature" reactor will be optimized to hydrolyze most of the "fast" xylon while minimizing destruction of any free sugars, the "high" temperature reactor will be optimized to hydrolyze most of the remaining hemicellulosic sugars while minimizing destruction of free sugars produced, and the two reactors can be run with different acid concentrations and different residence times.

The acid used in the process for acidification may be a mineral acid selected from hydrochloric acid, phosphoric acid, sulfuric acid, or sulfurous acid; however, sulfuric acid is preferred. Suitable organic acids may be carbonic acid, tartaric acid, citric acid, glucuronic acid, acetic acid, formic acid, or similar mono- or polycarboxylic acids.

In using typical biomass materials available in waste from agricultural, forest, vegetable or food process sources, such as feedstock of hemicellulosic materials, it has been found that xylan that is fast hydrolyzable (from about 7 to about 9 minutes) will proceed at predetermined low temperature conditions of from about 90° C. to about 180° C. depending on acid concentration and reaction time. Preferably, however, the predetermined low temperature will be about 120–155° C. The predetermined high temperature conditions will range from about 160° C. to about 220° C., and preferably, at 160°to 190° C. for the xylan that is slow hydrolyzable (from about 3 to about 5 minutes or different times depending on temperature or acid concentration).

Optimization of the hydrolysis of the xylan component to over 90% proceeds essentially by taking a slurry of hemicellulose and treating it in a first reactor under the above described predetermined low temperature conditions for a long residence time whereby the fast hydrolyzable xylan is hydrolyzed to xylose, which is removed for further biochemical conversion to ethanol. The residue feedstock containing the slow hydrolyzable xylan is then treated with dilute organic or inorganic acids under the above described predetermined high temperature conditions for a shorter or equal residence time to optimize hydrolysis of this latter xylan component, which is then enzymatically converted to ethanol.

As a result of the invention process, large amounts of ethanol can be economically provided as fuel from an almost unlimited supply of source material.

Further, in the context of the invention, two general options may be utilized to separate xylose containing liquids from solids. The liquids can be separated outside of the reactor by centrifugation or filtration, or the solids can be washed inside of the reactor by percolating acid.

The invention process may be conducted in batch, semicontinuous or continuous modes.

The foregoing is considered as illustrative only of the principles of the invention. Further, since numerous modifications and changes will readily occur to those skilled in the art, it is not desired to limit the invention to the exact construction and operation shown, and accordingly all suitable modifications and equivalents may be resorted to within the scope of the invention as defined by the claims that follow.

We claim:

1. A two-stage dilute acid prehydrolysis process on xylan containing hemicellulose in biomass, comprising:

treating a feedstock of hemicellulosic material comprising xylan that is slow hydrolyzable and xylan that is fast hydrolyzable under predetermined low temperature conditions with a dilute acid for a residence time sufficient to hydrolyze said fast hydrolyzable xylan at temperatures between about 90 to about 180° C. to xylose;

removing said xylose from said fast hydrolzable xylan and leaving a residue having slow hydrolyzable xylan;

treating said residue having slow hydrolyzable xylan with a dilute acid under predetermined higher temperature conditions for a residence time sufficient to hydrolyze said slow hydrolyzable xylan at temperatures between about 160°to 220° C. to xylose; and removing said xylose from said slow hydrolyzable xylan to obtain over 90% hydrolysis of xylan.

2. The process of claim 1, wherein the feedstock of hemicellulosic material is aspen wood meal, wheat straw, corn stover, corn cobs, corn fiber and waste paper.

3. The process of claim 1, wherein said dilute acid is selected from the group consisting of hydrochloric acid, phosphoric acid, sulfuric acid, sulfurous acid, carbonic acid, formic acid, acetic acid, tartaric acid, citric acid, glucuronic acid, 4-0-methylglucuronic acid, galacturonic acid and oligosaccharides containing these acids.

4. The process of claim 3, wherein the dilute acid is sulfuric acid.

5. The process of claim 4, wherein said sulfuric acid is about 0.1 to about 2.0 wt%.

6. The process of claim 5, wherein the predetermined low temperature is about 145° C. and the predetermined higher temperature is about 180° C.

7. The process of claim 6, wherein the residence time under the predetermined low temperature is about 8 minutes and the residence time under the predetermined higher temperature is about 4 minutes.

8. The process of claim 7, wherein the xylose yield is about 90.75% or greater.

* * * * *